United States Patent [19]

Cook

[11] Patent Number: 4,485,948

[45] Date of Patent: Dec. 4, 1984

[54] HAND GUN HOLSTER WITH ABRASION-RESISTANT LONGITUDINAL SPINE

[75] Inventor: Clifton L. Cook, Boise, Id.

[73] Assignee: Michaels of Oregon Co., Portland, Oreg.

[21] Appl. No.: 509,323

[22] Filed: Jun. 30, 1983

[51] Int. Cl.[3] ..... F41C 33/02

[52] U.S. Cl. ..... 224/243; 224/192; 224/206; 224/911

[58] Field of Search ..... 150/52 R; 224/192, 206, 224/243, 911, 912

[56] References Cited

U.S. PATENT DOCUMENTS

| | | | |
|---|---|---|---|
| 1,547,800 | 7/1925 | Franz | 224/911 X |
| 2,832,519 | 4/1958 | Ojala | 224/911 X |
| 3,804,306 | 4/1974 | Azurin | 224/243 X |
| 4,225,067 | 9/1980 | Bianchi et al. | 224/243 |
| 4,258,871 | 3/1981 | McMahon | 224/911 X |

*Primary Examiner*—Steven M. Pollard

*Attorney, Agent, or Firm*—Chernoff, Vilhauer, McClung, Birdwell & Stenzel

[57] ABSTRACT

A protective hand gun holster with an abrasion-resistant longitudinal spine structure capable of receiving hand guns with protruding sharp sights. The spine structure takes the form of a heavy, wear-resistant web treated with a polymer to prevent snagging and tearing by a gun sight.

3 Claims, 3 Drawing Figures

HAND GUN HOLSTER WITH ABRASION-RESISTANT LONGITUDINAL SPINE

BACKGROUND AND SUMMARY OF THE INVENTION

This invention pertains to a holster for a handgun, such as a revolver. More particularly, the invention relates to such a holster which is capable of receiving a handgun having the usual sharp, protruding sighting devices, with the holster being constructed with a special spine structure, which resists abrasion and tearing by such devices.

Although the instant invention has specific application to my Hand Gun Holster with Contractive Shape Memory, as disclosed in my copending U.S. patent application Ser. No. 425,423, filed Sept. 28, 1982, the invention is applicable to any fabric-lined holster constructed of pliable material, which is subject to abrasion and wear by the action of sighting devices commonly found on handguns. Particularly in the case where a handgun is repeatedly withdrawn from a holster in a rapid fashion, a "quick-draw", holsters are torn by the sights on handguns. Even in normal use, the withdrawal of a handgun from a holster may result in some abrading of the holster fabric.

Some holsters have been designed with abrasion-resistant material incorporated into the lining of the holster. This material has frequently been metallic, and, while protecting the holster, has damaged gun sights, resulting in reduced accuracy.

A general object of the present invention, then, is to provide an abrasion-resistant portion of a holster which will contact a gun sight and be minimally affected thereby.

Another object of the invention is to provide an abrasion-resistant spine structure in a holster which will not produce excessive wear on a handgun retained within such a holster.

A further object of the invention is to provide an abrasion-resistant spine structure usable in a contractive-shape-type-memory holster, which will not reduce the holster's contractive-shape performance.

According to a preferred embodiment of the invention, a web-like spine structure of nylon mesh is incorporated into the portion of a fabric-lined holster which will come in contact with the sights on a handgun. This mesh-like element is of considerably tougher material than is the normal lining of the holster, thereby providing additional protection for the holster while not damaging the sights on a handgun.

In a modification of the preferred embodiment, the mesh-like nylon spine structure is coated (treated) with a polymer film to produce an even tougher substance which will contact the sights on a handgun, and which will also provide a "slick" surface permitting rapid withdrawal of a handgun from a holster.

The proposed abrasion-resistant spine structure may, of course, be incorporated into conventional, noncontractive shape, fabric-lined holsters, and therein will provide additional protection for both the holster and a handgun.

These and other objects and advantages which are attained by the invention will become more fully apparent as the description which now follows is read in conjunction with the accompanying drawings.

DETAILED DESCRIPTION OF THE INVENTION

Figure 1:
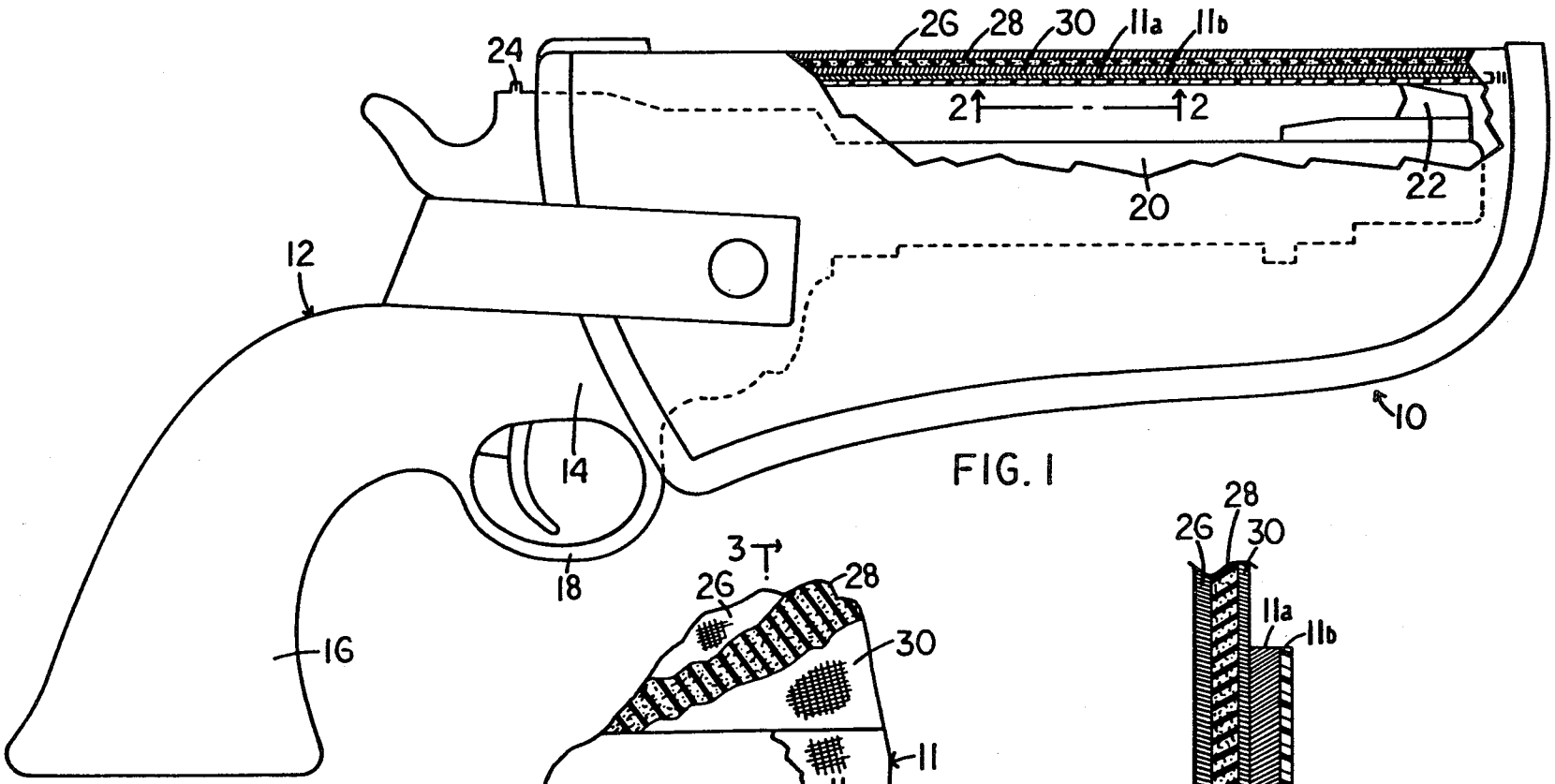
FIG. 1 is a side elevation of a holster constructed in accordance with the present invention incorporating an abrasion-resistant spine structure, with a handgun inserted therein. Portions have been broken away to illustrate details of construction.
Figure 3:
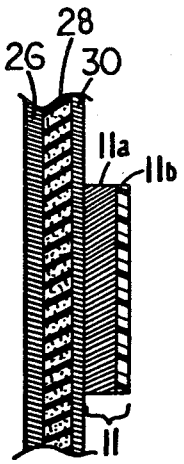
FIG. 3 is a cross-sectional view taken along line 3—3 in FIG. 2.
Figure 2:
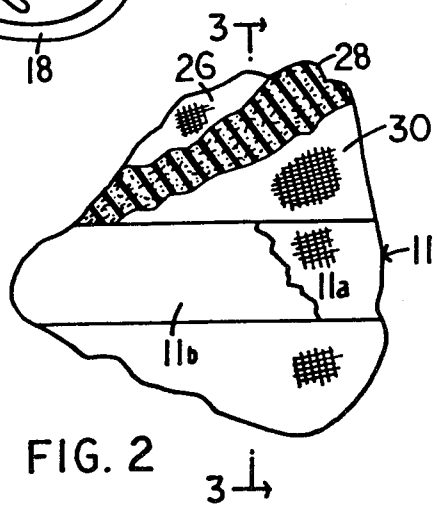
FIG. 2 is an enlarged, developed view taken generally along line 2—2 in FIG. 1.

Turning now to the drawings, and particularly FIG. 1, a holster incorporating, according to the invention, an abrasion-resistant longitudinal spine structure, is indicated generally at 10. The spine structure is shown at 11. A hand gun 12 is received within holster 10.

Handgun 12 includes a frame portion 14, a handle grip 16, a trigger guard 18 and a barrel 20. A front sight 22 is located at one end of barrel 20, and a rear sight 24 is located on the upper margin of frame 14.

Holster 10 is generally worn on a belt about an individual's hip. The holster and gun are carried in a vertical orientation, the gun resting either on its trigger guard, or on the end of its barrel, in the event that the holster is of closed-end type. The orientation of the handle grip, trigger guard and front sight produce a moment-arm which causes front sight 22 to rest against what would be the inner forward edge of a holster, as it was carried on a user's hip. The rear sight may or may not be covered by a portion of the holster, depending on the relative shape of the holster and the handgun.

Front sight 22 is representative of the general shape of sights found on handguns. This sight has a generally angular, sharp-edged configuration, which is functional to assist the user in aiming the handgun. This sharp-edged configuration produces wear on the inside of most holsters, and particularly fabric-lined holsters. In a righthanded drawing action, the user would grasp handle grip 16 while inserting his index finger through trigger guard 18, and withdraw handgun 12 from holster 10, generally rotating the gun in a counterclockwise direction in FIG. 1, producing an abrasive contact between front sight 22 and the inner portion of holster 10. Abrasive contact also occurs whenever the gun is returned to the holster.

Considering now particularly the construction of holster 10 and spine structure 11, and addressing attention to all of the drawing figures, the holster of the preferred embodiment includes an outer layer 26, which is formed herein of a 12-ounce nylon material. A median layer 28 is formed of a yieldably firm elastomer with retentive memory characteristics, generally a closed-cell polyethylene foam. An inner layer 30 is formed of a soft-surface fabric in order to protect the finish on any handgun inserted into the holster. Inner layer 30 herein takes the form of 4-ounce nylon material which has such characteristics. The layers are bonded together, and the three-layer pile folded to form a holster, the fold defining a longitudinal spine in the holster. This holster spine is subject to abrasion by sights, such a sights 22, 24.

In order to protect the spine portion of inner layer 30 which comes in contact with such sights, previously mentioned spine structure 11 is installed in accordance with this invention. Spine structure 11 herein is formed of a flexible, elongated, mesh-like web. Structure 11 runs along and is secured to the spine in holster 10 along a major portion of the inside of the holster spine. Structure 11 includes a mesh-like element 11*a* which is secured along the length of the holster's spine and folded over an opening in the holster and attached to the outer layer 26 thereof. Structure 11 in the preferred embodiment also includes a polymer film coating 11*b*, which provides additional abrasion resistance.

As can be appreciated now from the description which has just been given, and from the illustrations in the drawings, the holster with its abrasion-resistant longitudinal spine structure proposed by the present invention provides a wear resistant carrying device for a handgun, which will protect the handgun and will not be adversely affected by sharp-edged sights on the handgun.

While a preferred embodiment of the invention has been described herein, it is appreciated that variations and modifications may be made without departing from the spirit of the invention.

It is claimed and desired to secure by Letters Patent:

1. In an improved fabric-lined handgun holster, having a fold defining a longitudinal spine in the holster and a gun-receiving opening, the improvement comprising a flexible, elongated, web-like spine structure in the form of a ribbon, and means securing said spine structure at least along a major portion of the inside of the holster spine, extending from the opening in the holster, to provide abrasion protection for the spinal portion of the fabric lining in the holster.

2. The holster of claim 1, wherein said web-like spine includes a mesh-like element.

3. The holster of claim 2, wherein said mesh-like element is treated with a polymer film.

* * * * *